US005490122A

United States Patent [19]

Kojima

[11] Patent Number: 5,490,122

[45] Date of Patent: Feb. 6, 1996

[54] CLOCK APPARATUS

[75] Inventor: Masaaki Kojima, Kanagawa, Japan

[73] Assignee: Sony Corporation, Tokyo, Japan

[21] Appl. No.: 887,148

[22] Filed: May 22, 1992

[30] Foreign Application Priority Data

Jun. 5, 1991 [JP] Japan ..... 3-161087

[51] Int. Cl.[6] ..... G04B 19/22; G04B 47/00

[52] U.S. Cl. ..... 368/21; 368/10

[58] Field of Search ..... 368/10, 21–24, 368/82, 223

[56] References Cited

U.S. PATENT DOCUMENTS 4,669,891 6/1987 Rosevear ..... 368/21
4,681,460 7/1987 Nishimura ..... 368/21
4,884,254 11/1989 Kawai et al. ..... 368/21
4,887,251 12/1989 Takada ..... 368/21
4,998,229 3/1991 Kubota ..... 368/21
5,007,033 4/1991 Kubota et al. ..... 368/21

*Primary Examiner*—Vit W. Miska
*Attorney, Agent, or Firm*—Ronald P. Kananen

[57] ABSTRACT

A clock apparatus comprising an EEPROM 8 to store a shipping area code, an internal clock 12, a time button 2, and a liquid crystal display section 5. The time of the internal clock 12 is set by the time button 2, the shipping area code is set by the EEPROM 8, and the area information is set on the basis of the shipping area code. When the shipping area coincides with the purchase area, by merely setting the time of the purchase area, the world time can be easily obtained.

5 Claims, 4 Drawing Sheets

CLOCK APPARATUS

BACKGROUND OF THE INVENTION

1. Field of the Invention

The invention relates to a clock apparatus and, more particularly, to a clock apparatus which can display a world time.

2. Description of the Prior Art

There is known a clock apparatus which displays a time of an area where the user stays and can also display times of the other areas. In the case where the shipping area (hereinafter, referred to as a standard area) of the clock apparatus and the area in which the user purchased the clock apparatus (hereinafter, referred to as a purchase area) are located in the same area, the standard area and the time of the standard area (hereinafter, referred to as a standard time) need to be inputted into a memory of a microcomputer (hereinafter, referred to as a micom) or the like when setting the time. By inputting those two pieces of information, the times of the other areas can be known.

In the case where the user purchases the clock apparatus as mentioned above on Japan, the standard area is first set to "Japan" and the standard time is subsequently set. When the user uses the clock apparatus in an area other than Japan, for instance, in the U.S.A., the area code of the area in which the video camera is used (hereinafter, referred to as a present area) is set by using an area button or the like. Thus, the time in the U.S.A., namely, in the present area (hereinafter, referred to as a present time) is displayed and the times of the other areas can be known.

OBJECTS AND SUMMARY OF THE INVENTION

In the conventional clock apparatus which can display world times, in order to obtain the times of the other areas, it is necessary to input two pieces of information, that is, the standard area and the standard time into the memory.

It is, therefore, an object of the invention to provide a clock apparatus in which when the purchase area side and the shipping area coincide, only the standard time is set, so that the time of the other areas can be known.

The above, and other, objects, features and advantage of the present invention will become readily apparent from the following detailed description thereof which is to be read in connection with the accompanying drawings.

DETAILED DESCRIPTION OF THE PREFERRED EMBODIMENT

An embodiment of the invention will be described hereinbelow with reference to the drawings.

Figure 2:
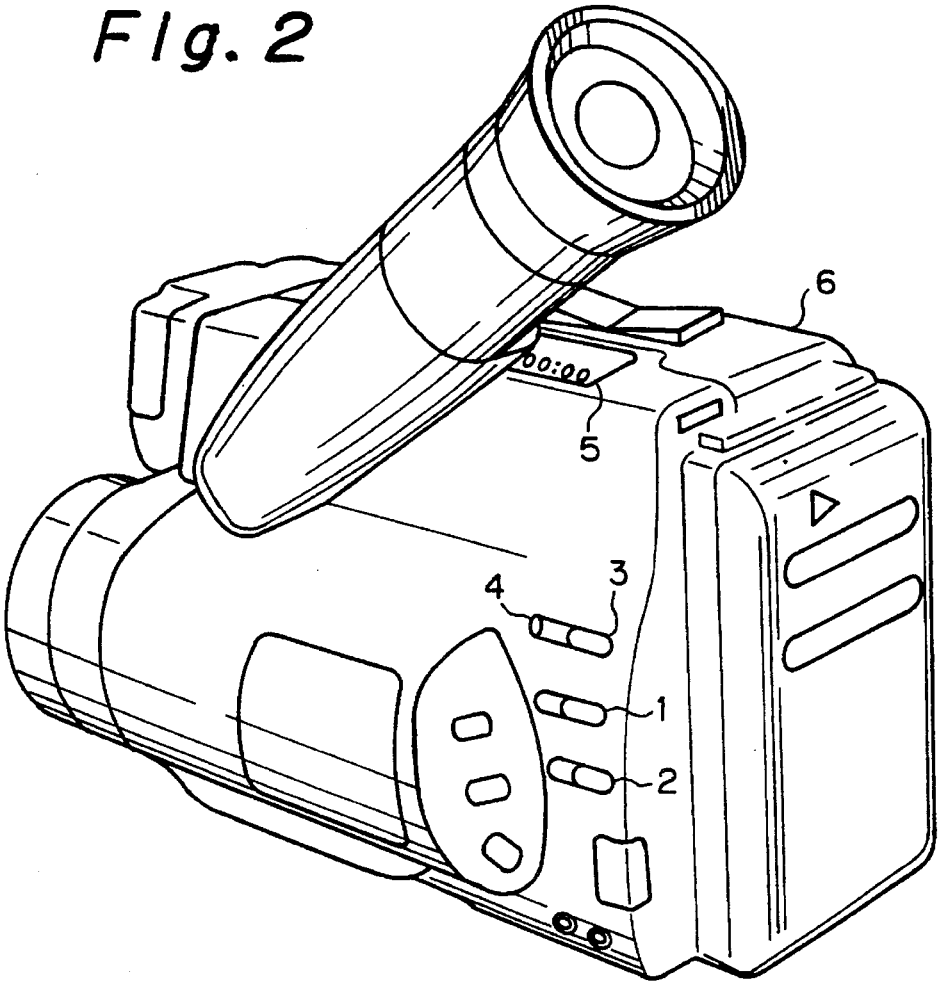
FIG. 2 is a perspective view of the video camera to which the invention is applied.

FIG. 2 is a perspective view of a video camera to which the invention is applied. In FIG. 2, a date (+) button 1, a time (progress) button 2, an area button 3, and a summer time button 4 are arranged on the side surface of the main body of a video camera 6. A liquid crystal display section (hereinafter, also referred to as an LCD) 5 is provided on the upper surface of the video camera 6.

The date (+) button 1 is used to adjust the date. The time (progress) button 2 is used to adjust the time. The displays of the date and time in the LCD 5 are respectively turned on/off by depressing the date (+) button 1 and time (progress) button 2. By continuously depressing the date (+) button 1 for a period of time of 500 msec or more, the date is automatically incremented. While the button 1 is depressed, the date is incremented every 300 msec.

For instance, the Japanese time assumes that the standard time and the area code for the time is that of Japan, which is area code 10. In the video camera 6 which the user purchased in Japan, the area code of the standard area has been preset to the area code 10 of Japan upon shipping from the factory. Therefore, when the video camera 6 is used in Japan, it is sufficient for the user to merely set the date and time by using the date (+) button 1 and time (progress) button 2.

In the case of initializing the time, a power switch of the video camera 6 is set to "camera" and a standby switch is set to "standby". The setting mode is set by simultaneously depressing both of the buttons 1 and 2 for two seconds. In the setting mode, the name of city and the area code allocated to the city are displayed.

By depressing the time (progress) button 2, the "year" setting mode is set. By depressing the date (+) button 1, "year" is set. By setting the "month" setting mode by depressing the time (progress) button 2 and by subsequently depressing the date (+) button 1, "month" is set. In a manner similar to the above, "day" and "hour" are set. By depressing the time (progress) button 2 at a time point when "hour" is set, the clock starts the operation and the displays of the area code and city name are erased. By again depressing the button 2, the display is switched to the counter display mode.

In the case where one country has a plurality of time zones, for instance, when the user purchases the video camera 6 in the U.S.A. or the like, the standard time has been preset to the time of the westmost area. Therefore, for instance, when the user purchases the video camera 6 in New York, the standard time has been set to the western time, namely, the time of the Los Angeles area. Accordingly, it is necessary to reset the standard time to the New York time, namely, the eastern time. In this case, the standard time can be changed by depressing the date (+) button 1. In the case where one country has a plurality of times, the standard time of such a country has been preset to the time of the westmost area.

The area button 3 is used to adjust the time of the video camera 6 to the time of the area where the user stays.

For instance, when the video camera 6 which the user purchased in Japan is used in Los Angeles of the U.S.A., the time (progress) button 2 is first depressed to thereby display the Japanese (standard) time and date. Subsequently, by depressing the area button 3, the area code is changed from the area code 10 of the standard area to the area code of the present area (Los Angeles), for instance, 17. Thus, a time difference between the standard time and the Los Angeles time is corrected by the micom, so that the Los Angeles time (present time) and date are displayed. The date and time of the present area are calculated on the basis of the information of the standard time, standard area, and present area. The area code, city display (Los Angeles), and western time are displayed in the electric view finder (hereinafter, referred to as an EVF). The area code, Los Angeles time, and world clock mark WM are displayed in the LCD 5. In the case where the standard area and the present area are different and the present time is displayed, the world clock mark WM is displayed. The area code and area in the EVF are merely displayed and are not recorded even when the video camera 6 is in the recording mode. When the standard area and the present area are equal, the displays of the world clock mark WM and the city name are erased.

Corresponding area codes are allocated to all of the areas in the world, respectively. Therefore, the present time is displayed by merely adjusting the area code of the present area by the area button 3. During the setting of the area, by continuously depressing the area button 3 for a period of time of 500 msec or more, the area is automatically incremented. While the area button 3 is depressed, the area is incremented every 300 msec. The area button 3 is made effective irrespective of the on/off states of the display of the date and time.

The summer time button 4 is used to switch the time mode from the winter time to the summer time. By once depressing the summer time button 4, the area code and city name which are displayed in the LCD 5 are maintained as they are and the time is progressed by only the time amount of the summer time. In this instance, the summer time mode is displayed in the EVF of the video camera 6. By again depressing the summer time button 4, the time information is delayed by only one hour as compared with the summer time and the summer time function is cancelled.

FIGS. 3A to 3E, 4A to 4C, and 5A to 5C show display examples of the time, date and the like which are displayed in the LCD (liquid crystal display section) 5. In those diagrams, each $A_1$ shows display of the LCD 5. Each $B_1$ denotes display in the EVF. The display content is displayed in the EVF only when the power source of the video camera 6 is ON.

FIGS. 3A to 3E show examples in the case of setting the present area to the standard area when the standard area and the present area are different. Practically speaking, FIGS. 3A to 3E show examples in the case where the standard area initialized to Japan is changed to Los Angels in the U.S.A.

Figure 3A:
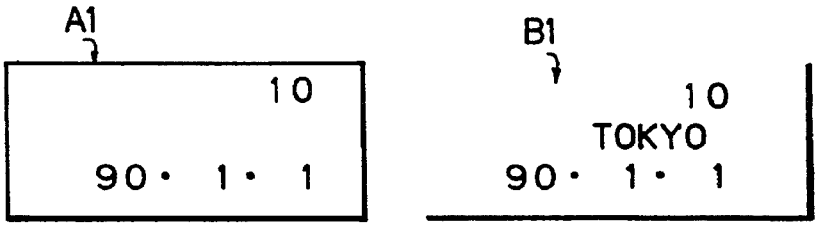
FIGS. 3A to 3E are diagrams showing display examples of a liquid crystal display section 5 and an EVF of the video camera to which the invention is applied.
Figure 3B:
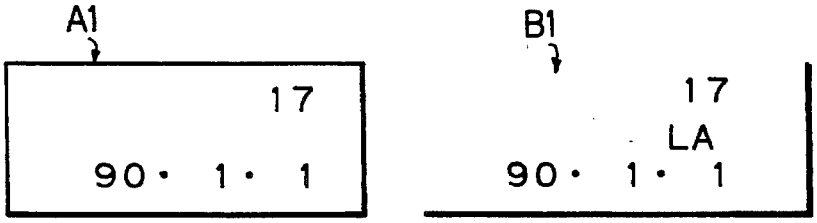
Figure 3C:
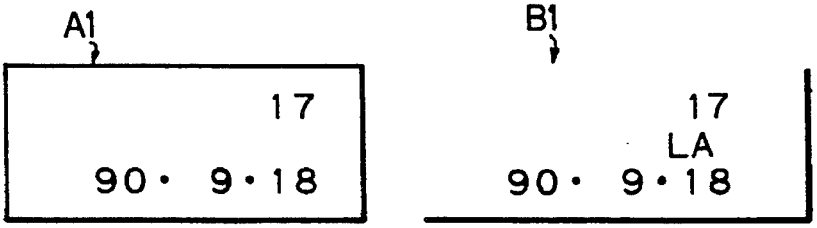
Figure 3D:
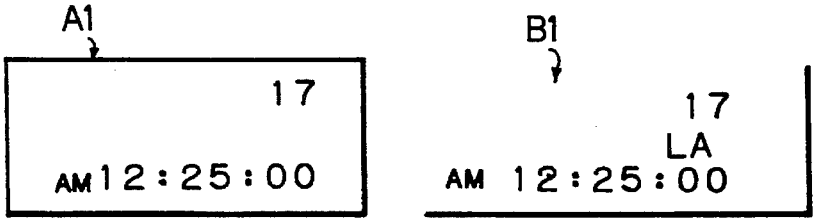
Figure 3E:
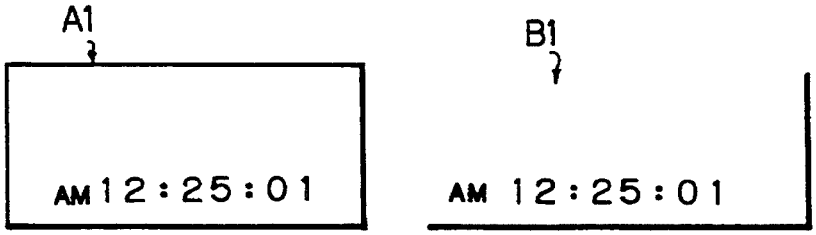

In FIG. 3A, the standard area code 10 of Japan which has been initialized and year/month/day are displayed in $A_1$. The initialized standard area code 10 and the city name "Tokyo" corresponding to the area code 10 (typically city name corresponding to the area code) and year/month/day are displayed in $B_1$. The standard area is initialized in accordance with-the destination upon shipping from the factory. When the standard area code 10 is changed to 17 (area code of Los Angeles), the date (+) button 1 is depressed and the area code is incremented and set to 17. The display examples in this instance are shown in FIG. 3B. The city name "Los Angels" corresponding to the standard area code 17 is displayed by $B_1$ in FIG. 3B. By operating the date (+) button 1 and time (progress) button 2, year/month/day and time are respectively set as shown in FIGS. 3C and 3D. The display contents of the LCD 5 and EVF which have finally been set are displayed in FIG. 3E.

Figure 4A:
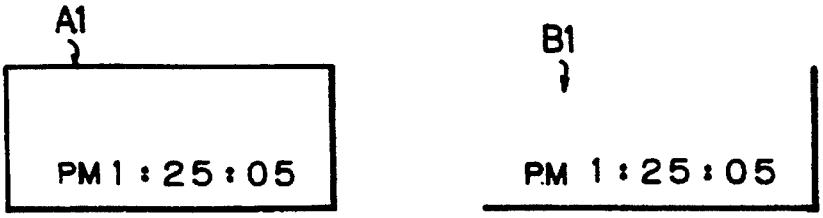
FIGS. 4A to 4C are diagrams showing display examples of the liquid crystal display section 5 and EVF of the video camera to which the invention is applied.
Figure 4B:
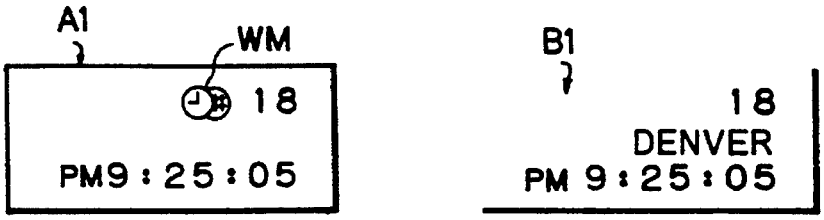
Figure 4C:
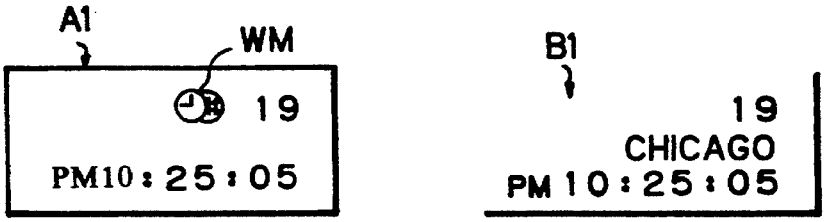

FIGS. 4A to 4C show examples in the case of displaying the time of the present area when the standard area and the present area are different. Practically speaking, FIGS. 4A to 4C show examples in the case where the video camera 6 in which the standard area has been set to Japan is used in Chicago and the time of Chicago is displayed.

In FIGS. 4A, the time (standard time) of Japan is displayed by $A_1$ and $B_1$. By depressing the area button 3, as shown by $A_1$ in FIG. 4B, the present area code 18, the time of present area and the world clock mark WM are displayed in the LCD 5. On the other hand, as shown by $B_1$ in FIG. 4B, the present area code 18, the city name "Denver" corresponding to the present area code 18, and the time of the present area are displayed in the EVF. By subsequently depressing the area button 3, as shown by $A_1$ in FIG. 4C, a desired present area code 19, the time of the desired present area, and the mark WM are displayed. Together with them, the present area code 19, the city name "Chicago" corresponding to the present area code 19, and its time are displayed by $B_1$ in FIG. 4C.

Figure 5A:
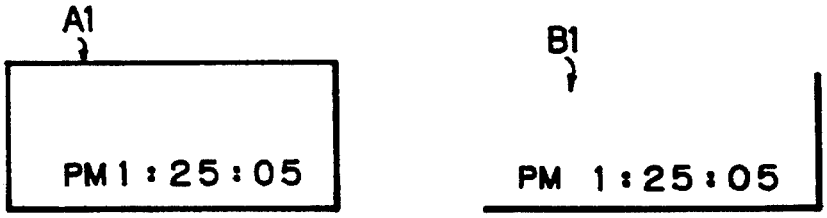
FIGS. 5A to 5C are diagrams showing display examples of the liquid crystal display section 5 and EVF of the video camera to which the invention is applied.
Figure 5B:
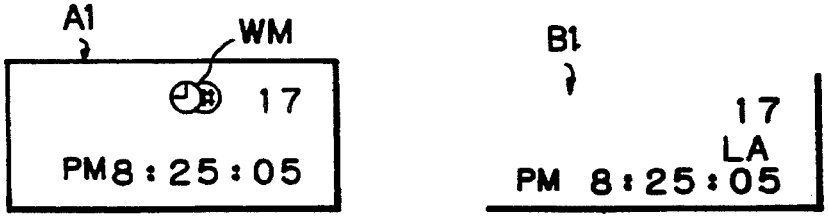
Figure 5C:
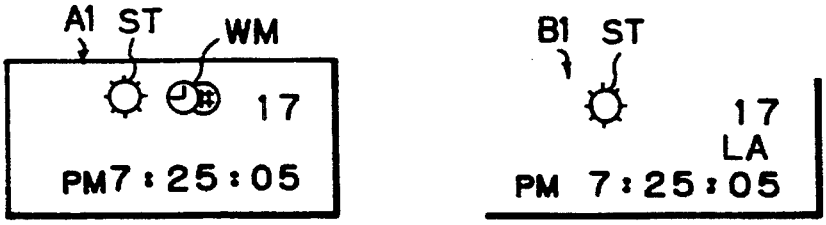

FIGS. 5A to 5C show examples in which the summer time of the present area is displayed when the standard area and the present area are different. Practically speaking, FIGS. 5A to 5C show the display examples in the case where the video camera 6 in which the standard area has been set to Japan is used in Los Angeles in the summer time season and the time is displayed.

In FIG. 5A, the time of Japan is displayed by $A_1$ and $B_1$. First, the area button 3 is depressed to set the present area to Los Angeles. The display content (present time) at this time is displayed by $A_1$ and $B_1$ in FIG. 5B. When the summer time button 4 is depressed to convert the present time into the summer time, the micom calculates the summer time on the basis of the present time. In this instance, a mark ST of the summer time is displayed as shown by $A_1$ and $B_1$ in FIG. 5C.

Figure 1:
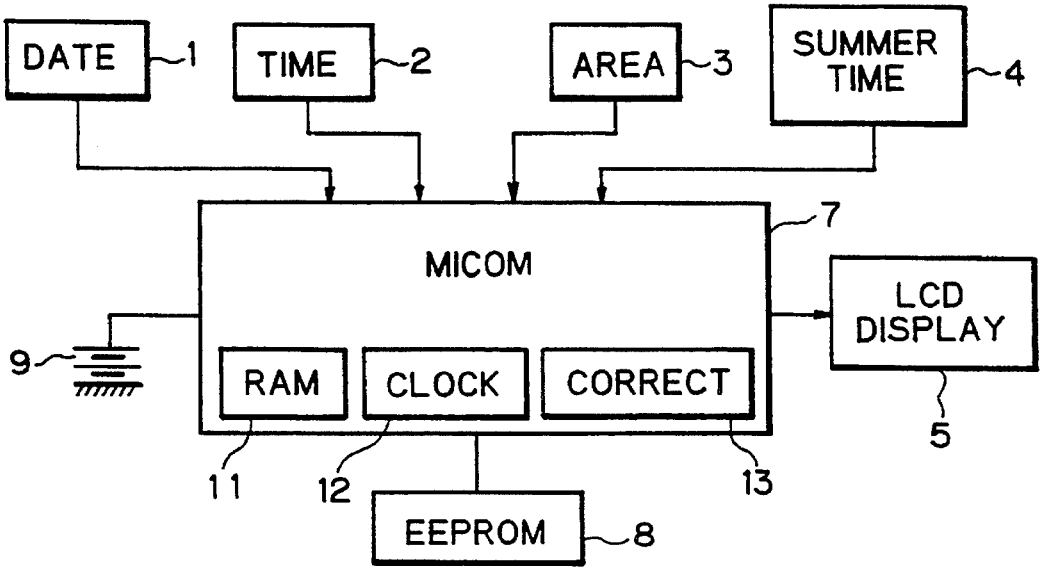
FIG. 1 is a block diagram regarding the display of a video camera to which the present invention is applied.

FIG. 1 is a block diagram regarding the display of the video camera 6. The date (+) button 1, time (progress) button 2, area button 3, and summer time button 4 are connected to a micom 7, respectively. The micom 7 has functions as a RAM 11, an internal clock 12, and a correcting circuit 13. A power source 9 such as a lithium battery or the like to drive the micom 7 is connected to the micom 7. Information of the micom 7 is backed up by the power source 9. An EEPROM 8 as a non-volatile memory is connected to the micom 7. An output of the micom 7 is connected to the LCD 5.

Upon shipping from the factory, the standard area code according to the destination is stored in the EEPROM 8 as an initial value. When the power source of the video camera 6 is turned on, the standard area code set in the EEPROM 8 is copied into the RAM 11. Information in the RAM 11 is backed up by the power source 9. The information of the RAM 11 is not erased so long as the power source 9 is not disconnected. An output of the RAM 11 is supplied to the LCD 5. On the user side, the standard time corresponding to the standard area is set and stored into the internal clock 12. After that, the information in the micom 7, namely, the information regarding the standard area code, standard area, and standard time is displayed on the LCD 5. By operating the date (+) button 1, time (progress) button 2, area button 3, and summer time button 4 as necessary, the date, time and area are changed.

For instance, when the time is changed by the time (progress) button 2, the micom 7 discriminates that the time of the internal clock 12 and the input time are different. To correct a time difference between the time of the internal clock 12 and the input time, those pieces of information are supplied to the correcting circuit 13. After the time difference was corrected by the correcting circuit 13, the time is displayed on the LCD 5.

Figure 6:
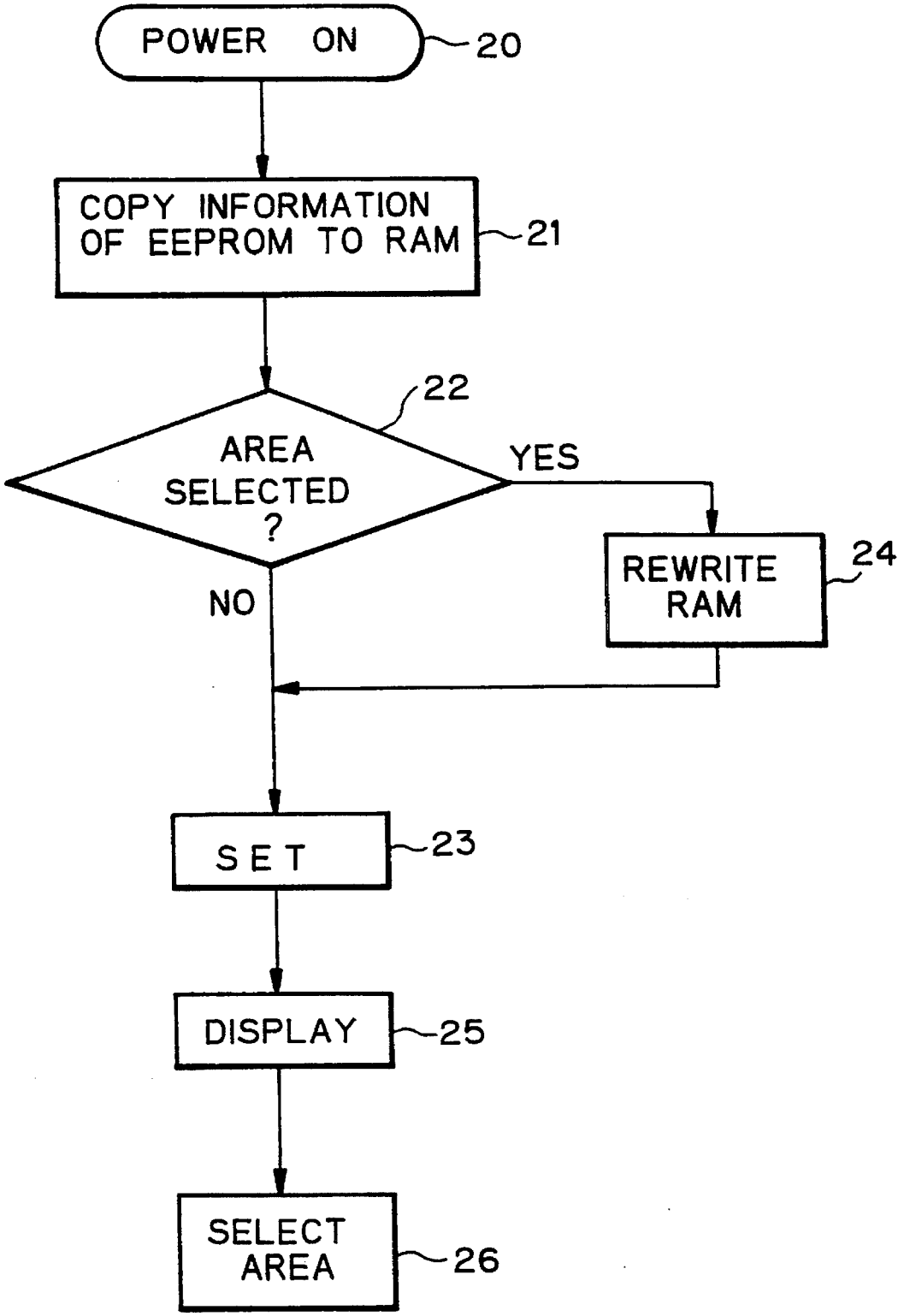
FIG. 6 is a flowchart regarding an area display of a clock apparatus according to the invention.

FIG. 6 is a flowchart for the clock apparatus of the present invention. When the power source is turned on (step 20), the information in the EEPROM 8 is copied into the RAM 11 in the micom 7 (step 21). A check is made to see if the standard area has been changed by the user or not (step 22). When the standard area is not changed, the date and the like are set (step 23). On the other hand, when it has been changed, the standard area set in the RAM 11 is changed (step 24) and step 23 follows. The information set in step 23 is displayed on the LCD 5 or the like (step 25). After that, the area is selected (step 26) when the standard area and the present area are different.

Although the embodiment has been described with respect to the example in which the clock apparatus of the invention is applied to the video camera, the invention is not limited to such an example but can be applied to all of the clock apparatuses which can display the world time. The contents which are displayed on the LCD 5 or the EVF can be also displayed by the language of the corresponding area (for instance, English in the case of the U.S.A.) or the like.

According to the invention, there is provided the clock apparatus in which the shipping area code is input into the memory in accordance with the destination upon shipping from the factory and, when the purchase area coincides with the shipping area, the standard time is set. Therefore, the user can omit the operation to set the standard area as an initial value.

Having described a specific preferred embodiment of the present invention with reference to the accompanying drawings, it is to be understood that the invention is not limited to that precise embodiment, and that various changes and modifications may be effected therein by one skilled in the art without departing from the scope or the spirit of the invention as defined in the appended claims.

What is claimed is:

1. A clock apparatus comprising:

a central controller;

first memory means connected to said central controller for storing a preset area code, said preset area code corresponding to a shipping location where said clock apparatus is to be shipped;

second memory means connected to said central controller;

clock means connected to said central controller for generating time information for said preset area code;

data input means connected to said central controller for allowing a user to change said preset area code to a present area code representing a present location of said clock apparatus which is different from said shipping location, said data input means storing said present area code in said second memory when said present area code differs from said preset area code;

a correction circuit for adjusting said time information from said clock means to reflect a time at said present location of said clock apparatus in said present area code; and display means connected to said central controller for displaying said time information;

wherein said central controller checks said second memory means to determine whether said present area code has been entered and supplies said display means with said time information from said correcting circuit for said present area code if said present area code has been entered and supplies said display means with said time information for said preset area code if said present area code has not been entered.

2. The clock apparatus as set forth in claim 1, wherein said first memory means comprises EEPROM.

3. The clock apparatus as set forth in claim 1, wherein said second memory means comprises RAM.

4. The clock apparatus as set forth in claim 3, wherein said first memory means comprises EEPROM and said central controller transfers said preset area code from said EEPROM to said RAM when checking whether said present area code has been entered.

5. The clock apparatus as set forth in claim 1, wherein said display means comprises an LCD display.

* * * * *